United States Patent [19]

Garvey

[11] 4,164,722

[45] Aug. 14, 1979

[54] ELECTROMAGNETIC ACTUATOR WITH TORQUE-COMPENSATING POLES

[75] Inventor: Daniel C. Garvey, Fort Collins, Colo.

[73] Assignee: Woodward Governor Company, Rockford, Ill.

[21] Appl. No.: 867,760

[22] Filed: Jan. 9, 1978

[51] Int. Cl.[2] ..... H01F 7/08

[52] U.S. Cl. ..... 335/272; 310/36

[58] Field of Search ..... 335/272, 276, 68, 100, 335/125, 225; 310/36, 37

[56] References Cited

U.S. PATENT DOCUMENTS

| | | | |
|---|---|---|---|
| Re. 25,992 | 3/1966 | Molitor | 310/37 |
| 1,597,736 | 8/1926 | Taeubert | 335/272 |
| 2,364,656 | 12/1944 | Price | 335/272 |
| 3,221,191 | 11/1965 | Cuches et al. | 335/272 |
| 3,229,170 | 1/1966 | Daugherty et al. | 335/272 |
| 3,229,171 | 1/1966 | Daugherty | 335/272 |
| 4,041,429 | 8/1977 | Parker et al. | 335/276 |

OTHER PUBLICATIONS

Yost, "Rotary Solenoids" Machine Design, 8/72, pp. 89–92.

*Primary Examiner*—Harold Broome

*Attorney, Agent, or Firm*—Leydig, Voit, Osann, Mayer & Holt, Ltd.

[57] ABSTRACT

An electromagnetic actuator has a stator and an armature both made of magnetically permeable material and each having a plurality of projecting poles spaced apart from each other. The armature poles and stator poles cooperate with each other so that each pair of opposed pole faces of an armature pole and a stator pole form a narrow working air gap for passing magnetic flux between the opposed pole faces. An electrically energizable coil produces magnetic flux which passes through the poles of the armature and stator and across the working air gaps. Selected pairs of the opposed armature and stator poles form a substantially constant air gap so that the attracting magnetic force on the armature increases as the armature moves in a first direction relative to the stator and decreases as the armature moves in the opposite direction, and other pairs of the opposed armature and stator poles form a variable air gap so that the attracting magnetic force on the armature decreases as the armature moves in the first direction and increases as the armature moves in the opposite direction.

13 Claims, 10 Drawing Figures

0° SHAFT POSITION

15° SHAFT POSITION

30° SHAFT POSITION

CONSTANT RADIUS POLES ONLY

VARIABLE RADIUS POLES ONLY

ELECTROMAGNETIC ACTUATOR WITH TORQUE-COMPENSATING POLES

DESCRIPTION OF THE INVENTION

The present invention relates generally to electromagnetic actuators and, more particularly, to "linear" actuators which produce an output torque or force over only a limited range of armature movement. For example, such actuators are typically used to move the throttle linkages of large governed engines in response to control signals from the governor system.

The operational characteristics of a theoretically perfect "linear" electromagnetic actuator are such that with the armature in any position, the magnetically exerted torque or force is essentially proportional to the magnitude of the coil excitation current. The present invention is applicable to such "linear" actuators that produce either linear motion or rotary motion.

It is also desirable for such electromagnetic actuators to have operational characteristics such that for any given coil excitation current, the magnetic torque or force on the armature remain essentially constant as the position of the armature is varied over its working range. This constant magnetic force characteristic is desirable to permit a relatively small range of energizing currents to move the armature across its entire working range, thereby maintaining a relatively constant power input to the actuator at all times. The size of the actuator must be designed to provide sufficient area to dissipate the heat generated therein at the maximum continuous power input. Thus, to keep the size to a minimum, it is desirable to minimize the differential between the minimum and maximum continuous power inputs required to move the armature over its entire range of travel, thereby minimizing the rated temperature rise of the actuator. For example, a rated temperature rise of 100° F. implies a constraint on the actuator size of 0.5 watts/in.$^2$, so that a continuous power input of 50 watts would require a surface area of 100 in.$^2$. With a relatively constant magnetic torque characteristic, only a small change in energizing current is required to move the armature from one position to another, thereby minimizing the rated temperature rise and, therefore, the required surface area.

It is a principal object of the present invention to provide an improved electromagnetic actuator which not only produces the desired "linear" operational characteristics, but also can be efficiently and economically manufactured in a compact size. In this connection, one specific object of the invention is to provide such an improved actuator which permits the use of an energizing coil of conventional configuration.

A further object of the invention is to provide such an improved electromagnetic actuator which provides a high volumetric efficiency, i.e., which makes efficient use of the volume occupied by the rotor and stator assemblies and the energization coil.

It is another object of the present invention to provide such an improved electromagnetic actuator which produces a relatively large magnetic torque so that a correspondingly large preload can be applied to the return spring.

Still another object of the invention is to provide an improved electromagnetic actuator of the foregoing type which permits the use of a return spring with a low scale.

These and other objectives of the invention are realized by providing an electromagnetic actuator comprising a stator and an armature both made of magnetically permeable material and each having a plurality of projecting poles spaced apart from each other, the armature poles and stator poles cooperating with each other so that each pair of opposed pole faces of an armature pole and a stator pole form a narrow working air gap for passing magnetic flux between the opposed pole faces, and an electrically energizable coil for producing magnetic flux that passes through the poles of the armature and stator and across the working air gaps between the opposed pole faces, with selected pairs of the opposed armature and stator poles producing a magnetic force that increases as the armature moves in a first direction relative to the stator and decreases as the armature moves in the opposite direction relative to the stator, and other pairs of the opposed armature and stator poles producing a magnetic force that decreases as the armature moves in the first direction relative to the stator and increases as the armature moves in the opposite direction relative to the stator.

DESCRIPTION OF THE DRAWINGS

Other advantages of the invention will become apparent as the following description proceeds with reference to an exemplary embodiment illustrated in the accompanying drawings, in which.

While the invention has been shown and will be described in some detail with reference to a preferred and exemplary embodiment, there is no intention thus to limit the invention to such detail. On the contrary, it is intended here to cover all alternatives, modifications and equivalents which fall within the spirit and scope of the appended claims.

DETAILED DESCRIPTION

Figure 1:
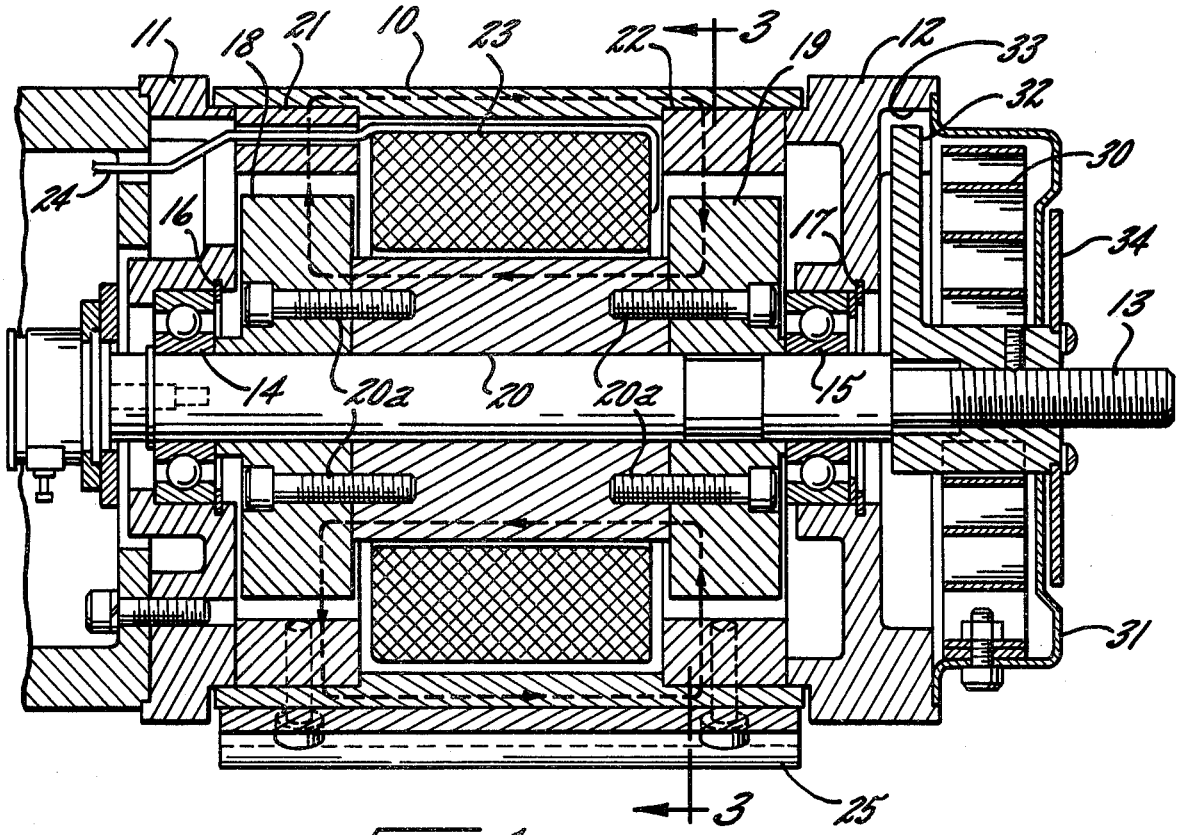
FIG. 1 is a vertical section of an electromagnetic actuator embodying the invention, with the addition of arrows to indicate the magnetic flux path.
Figure 2:
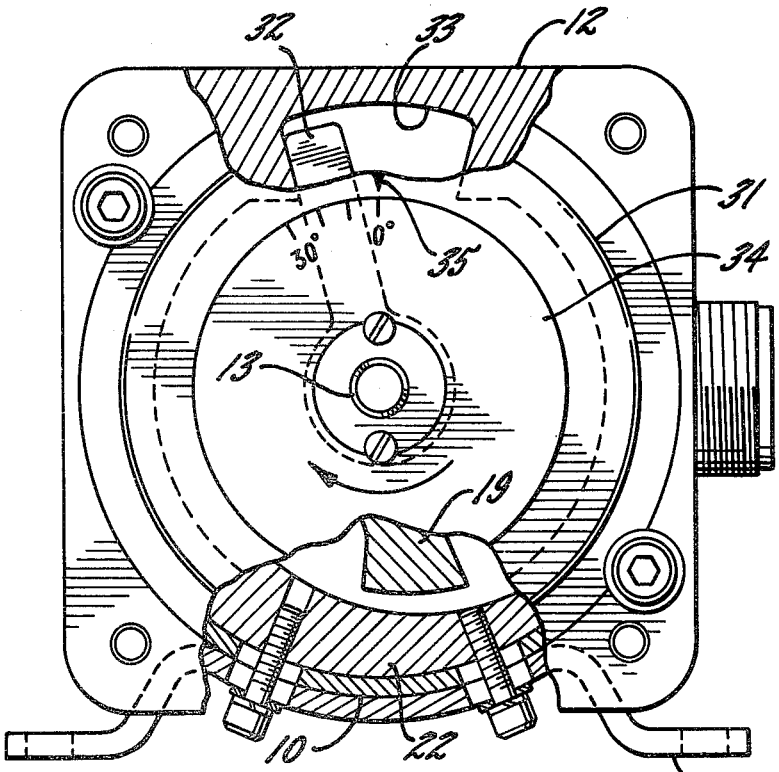
FIG. 2 is an end elevation taken from the right-hand end of the actuator shown in FIG. 1, with fragments thereof broken away to show the internal structure.
Figure 3:
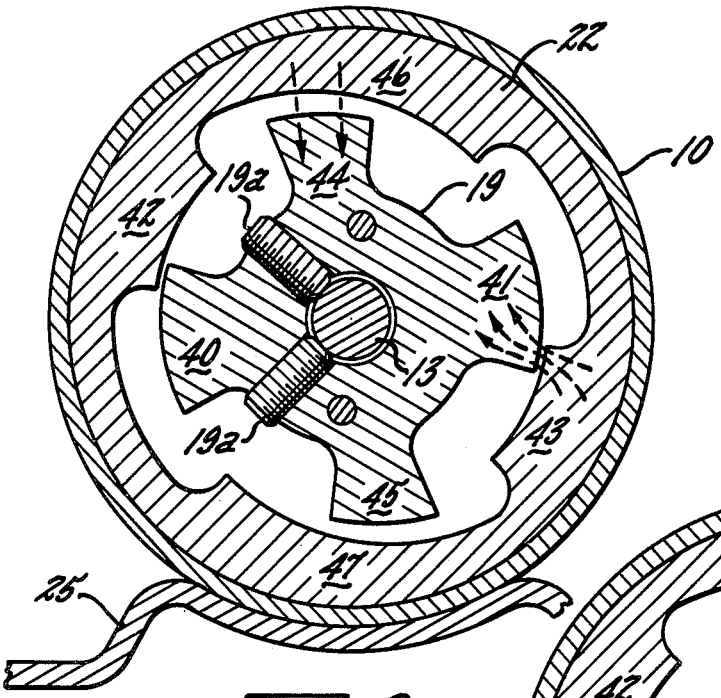
FIG. 3 is a section taken generally along line 3—3 in FIG. 1 with the rotor in a position where the indicator shown in FIG. 2 registers with the 0° mark on the dial which moves with the rotor, with the addition of arrows to indicate the magnetic flux path.
Figure 4:
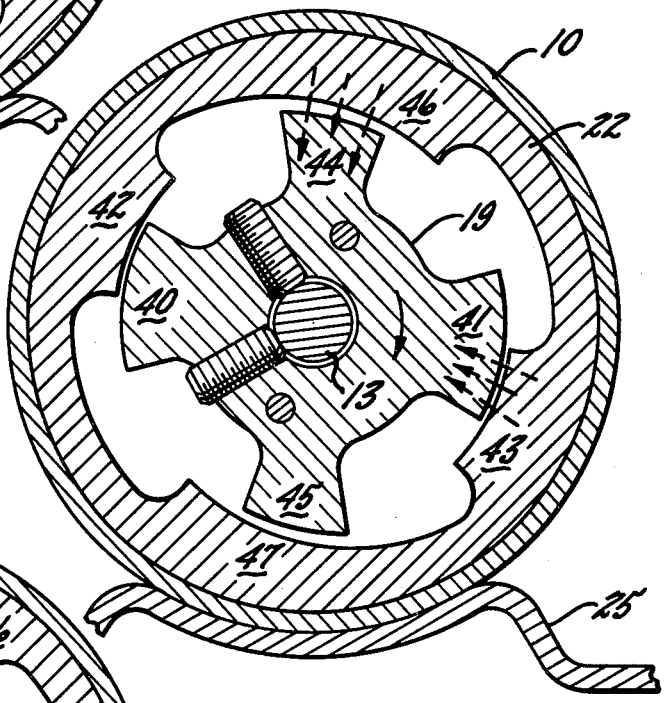
FIG. 4 is the same sectional view shown in FIG. 3 but with the rotor advanced to the 15° position, with the addition of arrows to indicate the magnetic flux path.
Figure 5:
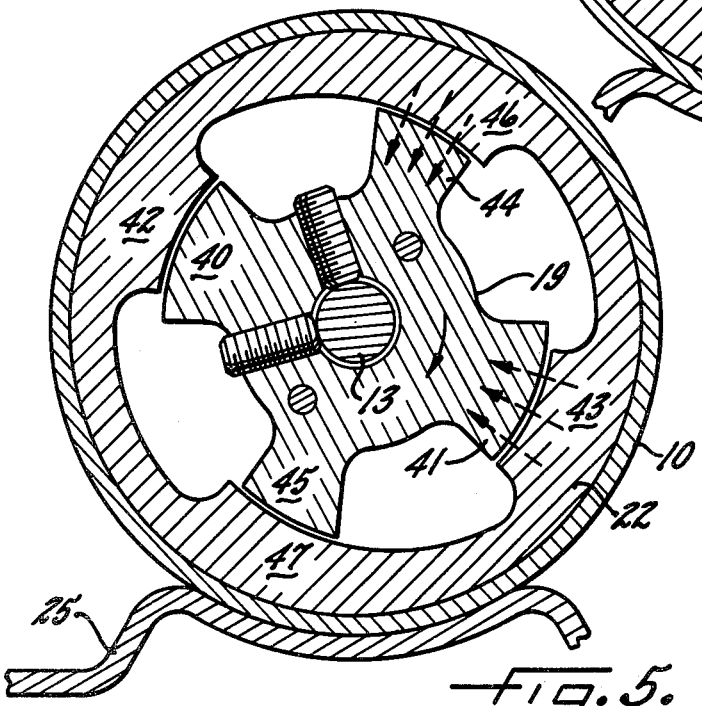
FIG. 5 is the same section shown in FIG. 3 but with the rotor advanced to the 30° position, with the addition of arrows to indicate the magnetic flux path.

Referring first to FIGS. 1 and 2, there is shown a rotational type electromagnetic actuator which includes a housing assembly comprising a body cylinder 10 affixed to a pair of end caps 11 and 12. Extending longitudinally through the center of this housing assembly is an elongated shaft 13 which is journaled in a pair of ball bearing assemblies 14 and 15 captured in the respective end caps 11 and 12 by retaining rings 16 and 17, respectively. This shaft 13 carries a pair of identical rotor elements 18 and 19 which are fastened to opposite ends of a cylindrical spacer 20 by screws **20*a* and to the shaft 13 by radial set screws 19*a* (FIGS. 3–5). This entire armature or rotor assembly comprising the rotor elements 18 and 19 and the spacer 20** is made of a magnetically permeable material and will be collectively referred to hereinafter as the "rotor".

For the purpose of turning the rotor in the clockwise direction as viewed in FIG. 2, a pair of stator elements 21 and 22 are mounted at opposite ends of the housing cylinder 10 and secured to a base 25. These stator elements 21 and 22 surround the respective rotors 18 and 19 and are positioned in longitudinal alignment therewith. The stator elements 21, 22 and the cylinder 10 are all made of a magnetically permeable material and will be collectively referred to hereinafter as the "stator".

To generate magnetic flux in the rotor and stator, a coil 23 is disposed within the annular space formed between the housing cylinder 10 and the spacer 20. That is, the outside diameter of the main body portion of the rotor (the spacer 20) is substantially smaller than the inside diameter of the opposed portion of the stator (the cylinder 10) to form an annular cavity for receiving the coil 23. This coil 23 is connected by leads 24 to a suitable power source, and when the coil is energized it creates an m.m.f. to drive magnetic flux through the rotor and stator and across the working air gap therebetween, as indicated by the arrows in FIG. 1. More specifically, the flux flows axially through the cylinder 10 and the spacer 20, and radially through multiple pairs of opposed poles formed by the rotor elements 18, 19 and the cooperating stator elements 21, 22. Because the iron or other magnetically permeable material forming the rotor and stator completely surrounds the coil 23, this construction makes efficient use of the volume occupied by the rotor and stator structures, so that the actuator can be manufactured in a compact size for any given output requirement. As can be seen most clearly in FIGS. 3–5, the rotor and the stator form multiple pairs of opposed poles so that the magnetic flux produced by energization of the coil 23 produces magnetic forces across the working air gaps between the opposed poles to urge the rotor in a clockwise direction as viewed in FIGS. 2–5.

For the purpose of urging the rotor in the counterclockwise direction as viewed in FIGS. 2–5, i.e., opposite the direction in which the rotor is urged by the magnetic forces, a return spring 30 is connected to one end of the shaft 13. This spring 30 is a ribbon torsion spring which is preloaded by winding and then held in place by securing one end to a shroud 31 and the other end to the shaft 13. Also carried by the shaft 13 is a stop arm 32 which extends radially outwardly from the shaft 13 into a cavity 33 formed by the end cap 12. The opposite ends of this cavity 33 form mechanical stops for the arm 32, thereby limiting angular movement of the shaft 13 to a 30° range of travel defined by the cavity 33.

For the purpose of indicating the angular position of the shaft 13 at any given time, a position indicating dial 34 is mounted on the hub of the stop arm 32, and a scale marked off in 10° increments from 0° to 30° is provided on the top edge of the dial 34. The movement of this scale relative to an indicator 35 provided on the shroud 31 adjacent the upper edge of the dial 34 provides a visible indication of the angular position of the rotor and its shaft 13 at any point along the 30° range of travel defined by the cavity 33.

In accordance with one important aspect of the present invention, at least one pair of opposed rotor and stator poles form pole faces with constant radii so that the air gap therebetween remains substantially constant to produce an increasing magnetic torque on the rotor as the pole faces move out of register with each other, and at least one other pair of opposed rotor and stator poles form pole faces with varying radii so that the air gap therebetween varies to produce a decreasing magnetic torque on the rotor as the constant radius pole faces move out of register with each other, thereby compensating the increasing torque produced by the constant radius poles. Thus, as can be seen in FIGS. 3–5, the illustrative rotor includes a first pair of poles 40 and 41 which form constant-radius pole faces cooperating with the constant-radius faces of an opposed pair of stator poles 42 and 43. Because of the constant radii of the pole faces formed by these two opposed pairs of poles 40, 42 and 41, 43, the air gaps between these two pole pairs remain constant regardless of the angular position of the rotor. However, the magnetic torque applied to the rotor by these two pole pairs varies with the angular position of the rotor.

A second pair of poles 44 and 45 on the rotor form pole faces which have a varying radius and which cooperate with opposed stator poles 46 and 47 also having a varying radius. Because of the varying radii of the pole faces formed by these two opposed pairs of poles 44, 46 and 45, 47, the air gaps between these two pole pairs vary with the angular position of the rotor, as does the magnetic torque applied to the rotor by these pole pairs.

With the pole structure provided by this invention, alternate pairs of opposed poles produce an increasing magnetic torque as the rotor moves in a clockwise direction, and the intervening pairs of opposed poles produce a decreasing magnetic torque as the rotor moves in the same direction. Conversely, when the rotor moves in the counterclockwise direction, the alternate pairs of opposed poles produce a decreasing torque, and the intervening pairs of opposed poles produce an increasing torque. As a result, the total magnetic torque produced by all the poles is relatively constant (for any given excitation current) across the entire range that the rotor is permitted to travel, i.e., within the limits set by the mechanical stops.

Figure 6:
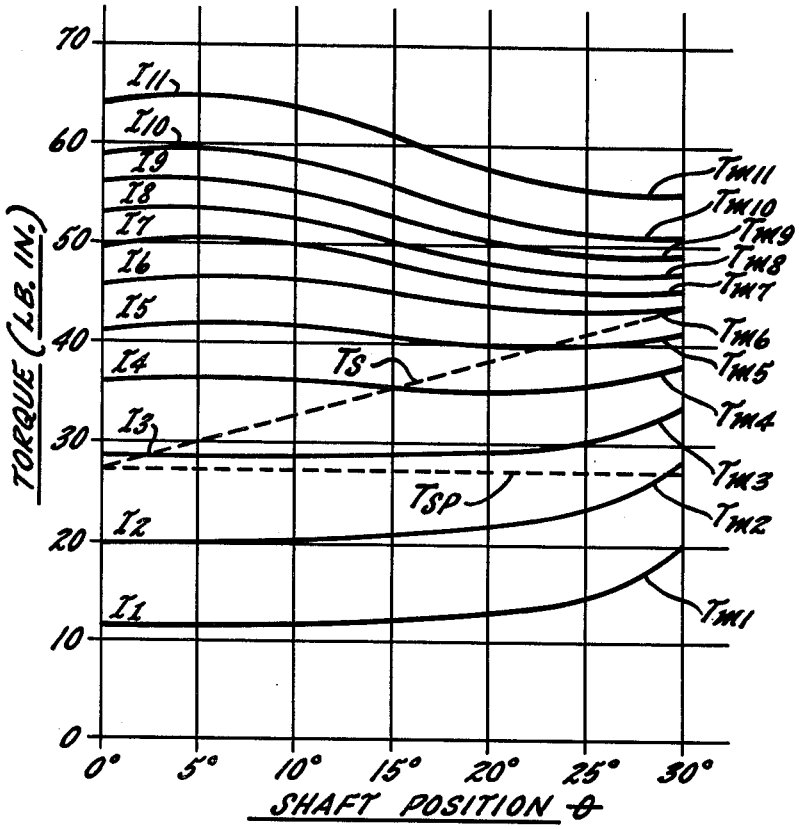
FIG. 6 is a series of magnetic torque vs. rotor position and spring torque vs. rotor position curves for the actuator shown in FIGS. 1–5.

This relatively constant magnetic torque is illustrated graphically in FIG. 6, which shows a family of magnetic torque $T_m$ vs. rotor position $\theta$ curves produced by an actuator as illustrated in FIGS. 1–5 with 450 turns of No. 15 copper wire in the energization coil 23. These curves illustrate 11 different levels of input current I1 through I11, ranging in value from 2.22 amp. (1000 ampere-turns) to 17.8 amp. (8010 ampere-turns). It can be seen that the magnetic input remained relatively constant, i.e., it varied within a very narrow range, within the major portion of the 30° travel range at every current level. The mutually compensating effect of the two different sets of poles to achieve this relatively constant magnetic torque can be more clearly understood by reference to the sequential views of the rotor at different angular positions in FIGS. 3–5.

In FIG. 3, the rotor is shown in its 0° limit position, where the spring torque is at a minimum. Here, the overlap between the constant radius rotor and stator poles is at its minimum and is so small that virtually all the flux crossing the constant-width air gap flows through a narrow area at the clockwise edge of the constant radius rotor pole, thereby producing a maximum clockwise torque. That is, the magnetic flux passing between the constant radius poles always tends to move the poles to the position of minimum magnetic reluctance, which is the position where the radial centerlines are aligned with each other. The farther the constant radius poles are moved away from this minimum reluctance position, the greater is the magnetic torque urging the poles toward the position of minimum reluctance, i.e., in the clockwise direction as viewed in FIGS. 3–5.

While the constant radius poles are at their maximum torque position in FIG. 3, the variable radius poles are at their minimum torque position. The magnetic torque produced by the variable radius poles is a function of the width of the working air gap formed by these poles, and this air gap increases as the rotor moves in the counterclockwise direction. Consequently, the magnetic torque from the variable radius poles is at a minimum when the rotor is in its most advanced counterclockwise position, which is the position shown in FIG. 3. This torque produced by the variable radius poles is always in the clockwise direction because the variable radius air gaps always have a shorter radius on the clockwise side of the centerline of the variable radius rotor poles than on the counterclockwise side.

In FIG. 4, the rotor is shown in its 15° position, which is half way between the 0° and 30° limit positions. In this 15° position, the spring torque is greater than in the 0° position, and thus the excitation must be increased to move the rotor from the 0° position to the 15° position. The overlap between the constant radius rotor poles and the constant radius stator poles in the 15° position is much greater than in the 0° position. Consequently, the magnetic torque produced by these poles is much lower than in the 0° position, because the opposed poles are closer to the full-register, minimum-reluctance position. On the other hand, the shift in the position of the variable radius poles (from FIG. 3 to FIG. 4) decreases the width of each variable radius air gap, causing the torque produced by the variable width poles to be substantially greater in the 15° position than in the 0° position. This torque is still in the clockwise direction because the radius of the air gap is still shorter on the clockwise side of the air gap of these poles than on the counterclockwise side. Thus, it can be seen that the angular movement of the rotor from the 0° position shown in FIG. 3 to the 15° position shown in FIG. 4 results in a decrease in the clockwise torque produced by the constant width poles and an increase in the clockwise torque produced by the variable width poles, with the total torque produced by the entire combination of poles remaining substantially the same as the total torque produced in the 0° position of FIG. 3.

In the 30° limit position shown in FIG. 5, the spring torque is at its maximum, so that excitation current required to move the rotor to this position is even higher than that required to move the rotor to the 15° position. As can be seen in FIG. 5, the constant radius rotor poles fully overlap the constant radius stator poles but there is still a small portion of each rotor pole face that extends beyond the opposed stator pole face in the counterclockwise direction because the circumferential dimension of the rotor pole faces is slightly greater than that of the stator pole faces. Thus, while the torque produced by the constant radius poles is at a minimum in this position, these poles still produce a small clockwise torque because the centerlines of the rotor and stator poles are still not fully aligned. The effect of the variable radius poles in this 30° position is to produce a maximum torque, i.e., exactly opposite the effect of the constant radius poles. The radii of these variable radius pole faces on both the rotor and stator always decrease in the clockwise direction, with the stator pole extending along a much longer arc than the rotor pole. Thus, when the rotor is at the 30° limit position shown in FIG. 5, the air gap between each pair of variable radius poles is at its minimum, and therefore these pole faces exert their maximum magnetic torque on the rotor.

It will be understood that the magnetic torque $T_m$ produced by energization of the coil 23 is constantly opposed by the spring torque $T_s$ applied to the rotor shaft 13 by the torsion spring 30. For any given level of energization current supplied to the coil 23, the magnetic torque $T_m$ is relatively constant over the limited range of rotor displacement permitted by the stop arm 32, but the magnitude of the magnetic torque $T_m$ can be adjusted by changing the magnitude of the energization current. More specifically, increasing the energization current increases the magnitude of the magnetic torque $T_m$, and decreasing the energization current decreases the magnitude of the magnetic torque $T_m$. Thus any given level of energization current produces a magnetic torque $T_m$ that advances the rotor against the opposing torque $T_s$ from the spring 30 until the rotor reaches a position where the magnetic torque $T_m$ is equal to the opposing torques $T_s$ and $T_L$ from the spring 30 and any external load applied to the threaded end of the shaft 13. The rotor will then remain at this equilibrium position until the current supply to the coil is changed or cut off, or until the load changes.

For any given load applied to the shaft 13, the energization current supplied to the coil 23 must be large enough to produce a magnetic torque $T_m$ sufficient to (1) advance the rotor and any external load thereon to a selected position and (2) to counterbalance the spring torque $T_s$ at that selected position. At any given level of energization current, any change in this magnetic torque across the limited range of rotor travel should occur at a rate less than the rate of change of the spring torque so that the rotor can be stopped at a selected position intermediate its limit positions. That is, the slope of the magnetic torque $T_m$ vs. rotor position $\theta$ characteristic should be less than the slope of the spring torque $T_s$ vs. rotor position $\theta$ characteristic. This is illustrated graphically in FIG. 6, where the spring torque characteristic $T_s$ is shown superimposed on the family of magnetic torque characteristics $T_m$ at different levels of energization currents. It can be seen that the slope of the spring torque characteristic $T_s$ is steeper than any of the magnetic torque characteristics $T_m$, so that the rotor will always reach a position where rotor advancement by the magnetic torque $T_m$ is limited by the spring torque $T_s$, provided the energization current is at a level which in fact causes the two torque characteristics to cross each other.

FIG. 6 also illustrates the specific angular positions to which the rotor will be advanced by the energization current levels represented by the magnetic torque characteristics $T_{m3}$, $T_{m4}$ and $T_{m5}$, which are the only $T_m$ curves that cross the particular spring torque characteristic $T_s$ illustrated. Thus, an energization current corresponding to curve $T_{m3}$ would advance the rotor to the 2° position (where $T_{m3}$ intersects $T_s$); energization at the $T_{m4}$ level would advance the rotor to the 15° position; and energization at the $T_{m5}$ level would advance the rotor to the 23° position. Of course, this assumes that no external load is applied to the rotor shaft 13, and the application of an external load will in effect raise the $T_s$ curve, and even change the shape of this curve if the external load is not constant across the range of rotor travel.

Figure 7A:
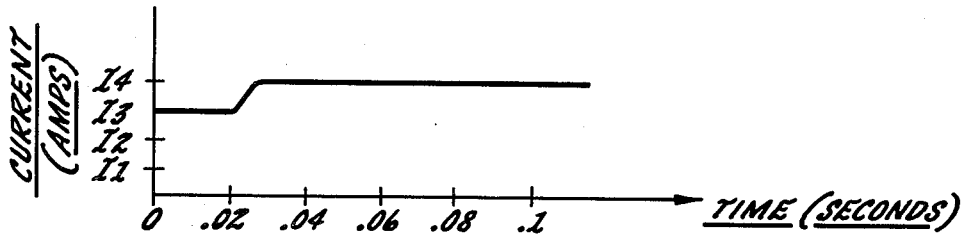
FIGS. 7A and 7B are curves of energization current vs. time and shaft position vs. time produced by a step change in the voltage applied to the coil in the actuator shown in FIGS. 1–5.
Figure 7B:
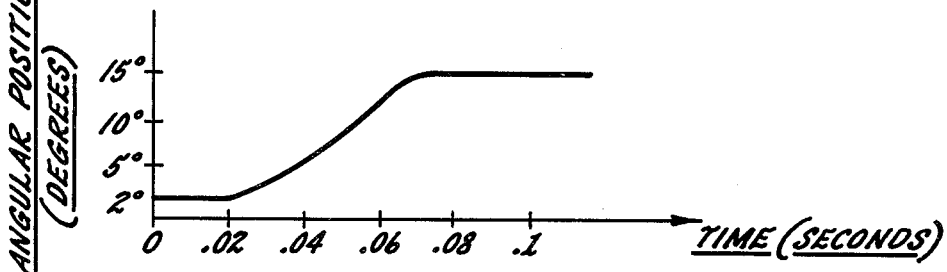

In FIGS. 7A and 7B, the changes in energization current and shaft position are shown as a function of time, for a shaft movement from the 2° position to the 15° position. These curves assume a step change in the voltage applied to the coil, with the current rise from I3 to I4 being delayed by the coil time constant (L/R).

To ensure that the rotor and the load are returned to the 0° limit position when the coil 23 is de-energized, it is desirable to have a relatively high preload on the spring 30. In FIG. 6, this spring preload is identified by the dashed horizontal line $T_{sp}$. The need for this spring preload means that a corresponding magnetic torque must be produced to overcome the spring preload whenever the rotor is advanced, and one of the advantages of the present invention is that it is capable of producing a relatively high magnetic torque in a relatively small structure. Thus, a high preload can be applied to the spring 30 without excessively increasing the size of the actuator.

It will be appreciated that the energization current required to move the rotor to any selected position can be controlled by known closed loop servo systems utilizing position feedback, such as the system described in the Parker-Garvey U.S. Pat. No. 4,041,429 owned by the assignee of the present invention. As also described in that patent, it may be desirable to use a return spring with a low spring scale so that only a narrow range of energization currents are required to move the rotor across its entire range of travel.

Figure 8:
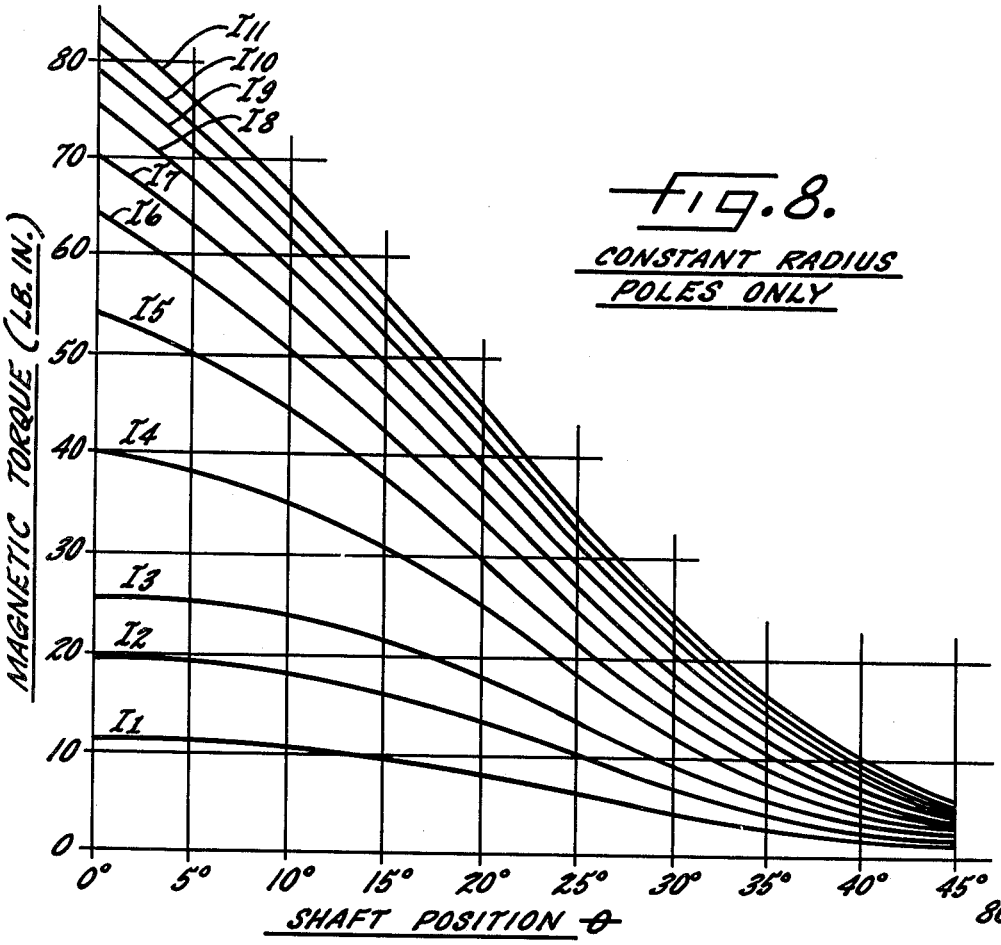
FIG. 8 is a series of magnetic torque vs. rotor position curves for an actuator having a rotor and stator with three pairs of constant radius poles.
Figure 9:
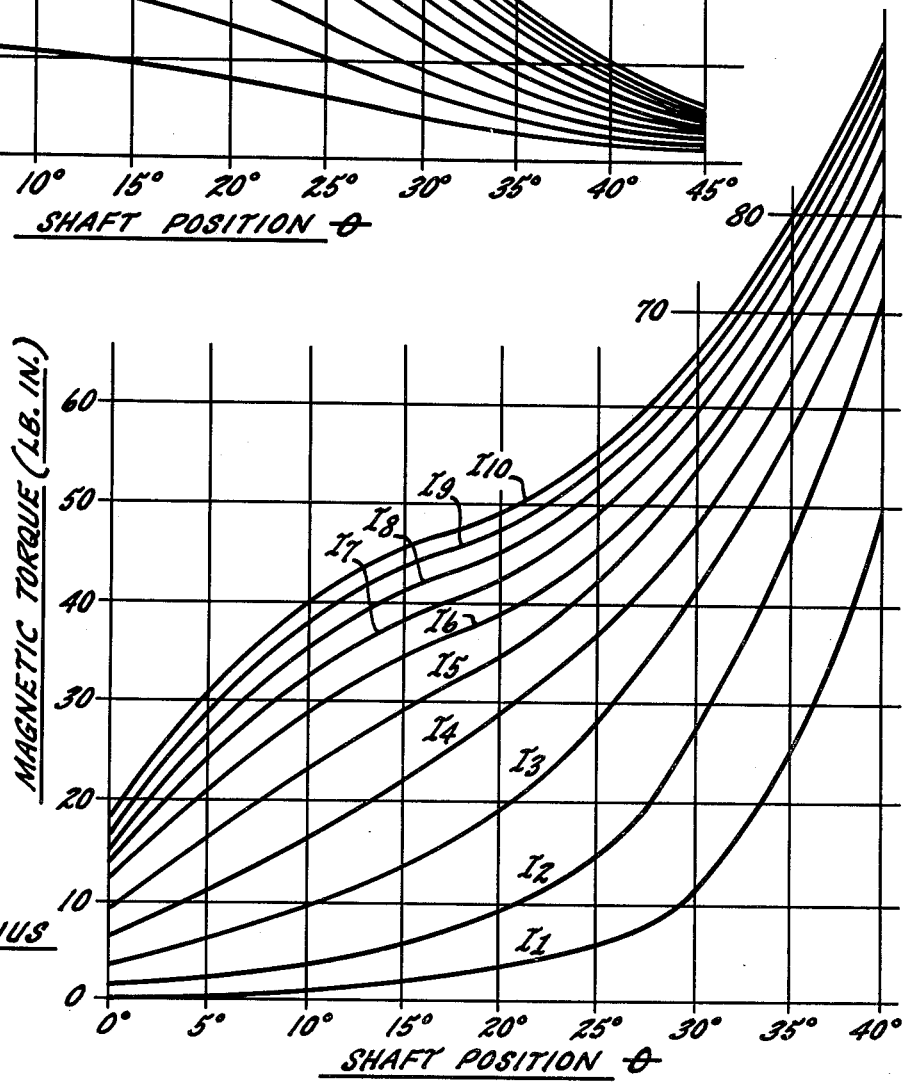
FIG. 9 is a series of magnetic torque vs. rotor position curves for an actuator having a rotor and stator with four pairs of variable radius poles.

To further facilitate an understanding of the present invention, two additional families of magnetic torque curves are shown in FIGS. 8 and 9. These curves were produced by two different electromagnetic actuators, one of which had only constant radius poles, and the other of which had only variable radius poles. More particularly, the curves shown in FIG. 8 were produced by a rotary actuator having three pairs of symmetrically arranged pole faces of constant radii, with each of the pole faces extending through an arc of about 50° around the rotor axis. In the rotor position identified as the 0° shaft position in FIG. 8, the rotor pole faces overlapped the stator pole faces by only about 5°. In the rotor position identified as the 45° shaft position in FIG. 8, the rotor pole faces where in full register with the stator pole faces. The energization coil used in this actuator had 500 turns, and was energized at 11 different levels of energization current ranging from 1 amp. (500 ampere-turns) to 10 amps. (5000 ampere-turns). As can be seen from the family of magnetic torque curves in FIG. 8, the magnetic torque was always at a maximum at the 0° shaft position and diminished at varying rates to a minimum at the 45° shaft position. At every level of energization current, there was a very significant different between the maximum and minimum magnetic torque values at the 0° and 45° shaft positions.

Turning next to FIG. 9, the torque curves shown in this figure were obtained with an electromagnetic actuator having four symmetrically spaced pole pairs of varying radii. Each of the rotor pole faces extended through an arc of about 45° around the rotor axis, with about a 10% increase in radius from one edge of the pole to the other. Each of the stator pole faces extended through an arc of about 60° around the rotor axis, with about a 20% increase in radius from one edge of the pole face to the other. The radii of the rotor and stator pole faces both increased in the same direction. The rotor position in which the two minimum-radius edges of each pair of opposed poles were in register with each other is identified as the 40° shaft position in FIG. 9, and the rotor position in which the minimum-radius edges of each pair of opposed poles were 40° out of register with each other is identified as the 0° shaft position in FIG. 9. The energization coil used in this actuator had 335 turns, and was energized at current levels ranging from 1.49 amps. (500 ampere-turns) to 14.92 amps. (5000 ampere-turns). As can be seen from the family of curves in FIG. 9, the maximum magnetic torque was always produced at the 40° shaft position, where the air gap between the variable radius pole faces was at a minimum. Conversely, the minimum magnetic torque was always produced at the 0° shaft position, where the air gap between the opposed pole faces was at a maximum. At different levels of energization current, the magnetic torque changed at different rates over the 40° range of rotor travel, but there was always a very significant difference between the minimum and maximum torque values obtained at any given level of energization current.

The two families of curves shown in FIGS. 8 and 9 graphically demonstrate the fact that the constant radius poles and variable radius poles produce magnetic torque curves which slope in opposite directions. Thus, it can be appreciated that when both types of pole faces are incorporated in the same actuator, the magnetic torque characteristics of the two different types of poles tend to compensate each other, producing a net magnetic torque which is relatively constant over a selected range of rotor movement.

As can be seen from the foregoing detailed description, this invention provides an improved electromagnetic actuator which not only produces the desired "linear" operational characteristics, but also can be efficiently and economically manufactured in a compact size, using an energizing coil of conventional configuration. The actuator not only produces a relatively constant magnetic torque across the entire range of rotor movement, but also produces a relatively large magnetic torque so that a corresponding preload can be applied to the return spring. Because of the relatively constant magnetic torque characteristics, this invention also permits the use of a return spring with a low scale. Moreover, an actuator embodying this invention can be constructed with a high volumetric efficiency because the iron or other magnetically permeable material which forms the rotor and stator structure completely surrounds the energization coil.

I claim as my invention:

1. An electromagnetic actuator comprising a stator and a rotor both made of magnetically permeable material and each having a plurality of projecting poles spaced apart from each other, the rotor poles and stator poles cooperating with each other so that each pair of opposed pole faces of a rotor pole and a stator pole form a narrow working air gap for passing magnetic flux between the opposed pole faces, an electrically energizable coil for producing magnetic flux that passes through the poles of said rotor and stator and across the working air gaps between the opposed pole faces, at least one pair of the opposed rotor and stator poles forming an air gap that remains substantially constant to produce an increasing magnetic torque on said armature as said pole faces move out of register with each other and a decreasing magnetic torque as said pole faces move toward register with each other, and at least one pair of the opposed rotor and stator poles forming an air gap that varies to produce a decreasing magnetic torque on said rotor as the poles forming the constant air gap move out of register with each other and increasing magnetic torque as the poles forming the constant air gap move toward register with each other, whereby the change in the magnetic torque produced by said poles forming the variable air gap at least partially compensates for the change in the magnetic torque produced by the poles forming the constant air gap.

2. An electromagnetic actuator as set forth in claim 1 wherein said rotor is generally cylindrical in shape with the rotor poles extending radially outwardly therefrom at opposite ends thereof, and said stator is a sleeve concentrically surrounding said rotor with the stator poles extending radially inwardly therefrom at opposite ends thereof for cooperation with the outwardly extending poles of said rotor, the outside diameter of the main body portion of said rotor being substantially smaller than the inside diameter of the opposed portion of said stator so as to form an annular cavity for receiving said coil, the magnetic flux induced in said stator flowing axially through said rotor and stator and radially through the poles extending radially therefrom.

3. An electromagnetic actuator as set forth in claim 1 wherein the rate of change of the torque produced by said constant radius pole faces is substantially the same as the rate of change of the torque produced by said variable radius pole faces within a predetermined range of angular movement of said pole faces relative to each other, whereby the net torque produced by all the opposed poles within said predetermined range is substantially constant.

4. An electromagnetic actuator as set forth in claim 1 wherein the radii of said variable radius rotor and stator pole faces increase and decrease in the same circumferential direction, with the stator pole faces extending through a longer arc than the rotor pole faces.

5. An electromagnetic actuator as set forth in claim 1 which includes a spring urging said rotor in a direction opposite the direction in which the rotor is urged by said magnetic torque, and wherein the spring torque is greater than the magnetic torque produced by different levels of energization current at different points along the range of rotor travel so that advancement of the rotor in response to the magnetic torque will be limited by said spring torque.

6. An electromagnetic actuator as set forth in claim 1 which includes mechanical stops for limiting the rotor displacement to a preselected range.

7. A rotary electromagnetic actuator comprising a stator and a rotor both made of magnetically permeable material and each having a plurality of radially projecting poles spaced apart from each other, the stator poles and rotor poles cooperating with each other so that each pair of opposed pole faces of a stator pole and a rotor pole form a narrow working air gap for passing magnetic flux between the opposed pole faces, an electrically energizable coil for producing magnetic flux that passes through the poles of said rotor and stator and across the working air gaps between the opposed pole faces, at least one pair of the opposed stator and rotor poles forming opposed pole faces with constant radii of curvature so that the air gap therebetween remains substantially constant during angular movement of said pole faces relative to each other, thereby producing an increasing torque as said pole faces are moved out of register with each other and a decreasing torque as said pole faces are moved into register with each other, at least one pair of the opposed stator and rotor poles forming opposed pole faces with varying radii of curvature so that the air gap therebetween varies during angular movement of said pole faces relative to each other, thereby producing a decreasing torque as said constant radius pole faces are moved out of register with each other and an increasing torque as said constant radius pole faces are moved into register with each other.

8. An electromagnetic actuator comprising a stator and an armature both made of magnetically permeable material and each having a plurality of projecting poles spaced apart from each other, the armature poles and stator poles cooperating with each other so that each pair of opposed pole faces of an armature pole and a stator pole form a narrow working air gap for passing magnetic flux between the opposed pole faces, an electrically energizable coil for producing magnetic flux that passes through the poles of said armature and stator and across the working air gaps between the opposed pole faces, selected pairs of the opposed armature and stator poles producing a magnetic force that increases as the armature moves in a first direction relative to the stator and decreases as the armature moves in the opposite direction relative to the stator, other pairs of the opposed armature and stator poles producing a magnetic force that decreases as the armature moves in said first direction relative to the stator and increases as the armature moves in the opposite direction relative to the stator.

9. An electromagnetic actuator as set forth in claim 1 wherein said selected pairs of poles and said other pairs of poles are spaced symmetrically with respect to the axis of movement of the armature.

10. An electromagnetic actuator as set forth in claim 8 wherein the rate of change of the magnetic force produced by said selected pairs of poles is substantially the same as the rate of change of the magnetic force produced by said other pairs of poles within a predetermined range of armature movement, whereby the net magnetic force produced by all the poles within said predetermined range is substantially constant.

11. An electromagnetic actuator as set forth in claim 8 which includes a spring urging said armature in a direction opposite the direction in which the armature is urged by said magnetic forces, and wherein the spring force is greater than the magnetic force produced by different levels of energization current at different points along the range of armature travel so that advancement of the armature in response to the magnetic forces will be limited by said spring force.

12. An electromagnetic actuator as set forth in claim 8 which includes mechanical stops for limiting the armature displacement to a preselected range.

13. An electromagnetic actuator comprising a stator and an armature both made of magnetically permeable material and each having a plurality of projecting poles spaced apart from each other, the armature poles and stator poles cooperating with each other so that each pair of opposed pole faces of an armature pole and a stator pole form a narrow working air gap for passing magnetic flux between the opposed pole faces, an electrically energizable coil for producing magnetic flux that passes through the poles of said armature and stator and across the working air gaps between the opposed pole faces, selected pairs of the opposed armature and stator poles forming a substantially constant air gap so that the attracting magnetic force on the armature increases as the armature moves in a first direction relative to the stator and decreases as the armature moves in the opposite direction relative to the stator, other pairs of the opposed armature and stator poles forming a variable air gap so that the attracting magnetic force on the armature decreases as the armature moves in said first direction and increases as the armature moves in said opposite direction.

* * * * *